US005329710A

United States Patent [19]

Huddleston

[11] Patent Number: 5,329,710

[45] Date of Patent: Jul. 19, 1994

[54] FOLDING TABLE TOP FOR AN IRONING BOARD

[76] Inventor: Leona B. Huddleston, 1034 Bancroft Rd., Keller, Tex. 76248

[21] Appl. No.: 962,270

[22] Filed: Oct. 15, 1992

[51] Int. Cl.[5] ..... D06F 81/00; A47B 35/00; E05C 1/10; E05D 1/04

[52] U.S. Cl. ..... 38/104; 108/50; 108/90; 292/DIG. 38; 16/225

[58] Field of Search ..... 38/103, 104, 112, 137, 38/140, 142; 108/11, 13, 50, 90, 65; 16/224, 225, 355, 385, DIG. 13; 292/DIG. 38; 20/19, 52, 287; 403/220, 375

[56] References Cited

U.S. PATENT DOCUMENTS

| | | | |
|---|---|---|---|
| 482,348 | 9/1892 | Fowler | 38/107 |
| 894,374 | 7/1908 | Von Elgen | 292/19 |
| 898,707 | 9/1908 | Ward | 108/90 |
| 1,035,896 | 8/1912 | Padley | 38/112 X |
| 1,072,060 | 9/1913 | Thompson | 108/150 |
| 1,089,289 | 3/1914 | Thompson | 108/150 |
| 1,496,556 | 6/1924 | Romesberg | 108/90 |
| 2,175,572 | 10/1939 | Ruhl | 38/104 |
| 2,468,962 | 5/1947 | Czak | 311/106 |
| 2,529,051 | 11/1950 | Sherman | 311/106 |
| 2,556,943 | 6/1951 | Reisman | 311/106 |
| 2,634,183 | 4/1953 | Derman | 311/107 |
| 2,942,922 | 6/1960 | Fraser | 311/106 |
| 2,978,020 | 4/1961 | Paulsrude | 16/225 |
| 3,049,825 | 8/1962 | Boyd | 38/112 |
| 3,245,161 | 4/1966 | Adiletta et al. | 38/104 |
| 3,441,975 | 5/1969 | Shepard | 16/225 |
| 4,223,787 | 9/1980 | Lowry et al. | 292/DIG. 38 X |
| 4,828,132 | 5/1989 | Francis, Jr. et al. | 16/225 X |

FOREIGN PATENT DOCUMENTS

| | | | |
|---|---|---|---|
| 0176595 | 4/1917 | Canada | 38/112 |

*Primary Examiner*—Clifford D. Crowder
*Assistant Examiner*—Ismael Izaguirre
*Attorney, Agent, or Firm*—Guy V. Manning

[57] ABSTRACT

A foldable table top for converting an ironing board to a utility table comprises equivalent rectangular sections coupled together by a flexible hinge. Two handles on opposite ends of the table top latch together to hold the table top in a folded position for storage and transportation. The handles double as attachment brackets that pivot beneath the ironing board deck, snugly receiving each end of the deck within a recess to sandwich the ends between the handles and the bottom of the table top. If the ironing board has adjustable legs, the resulting utility table may be lowered or raised to the extent of the adjustment of the ironing board legs for the convenience of the user.

15 Claims, 3 Drawing Sheets

FOLDING TABLE TOP FOR AN IRONING BOARD

BACKGROUND OF THE INVENTION

1. Field of the Invention

This invention relates to improvements to ironing boards and, in particular, to an apparatus for converting a conventional ironing board into a utility table. More particularly, this invention discloses a folding table top for attachment to the planar deck of an ironing board.

2. Description of Related Art.

For temporary work surfaces, people often need wide, horizontal surfaces elevated above the floor, such as a large table may provide. In homes, a dining room table may serve the purpose if available, but in small quarters, a large table may not be available because of space constraints. Where space may be at a premium, a plurality of collapsible card tables could serve the purpose if sufficiently rigid, but card tables seldom match in height or shape, presenting an irregular instead of a smooth work surface. A need exists for a utility table that easily can be set up and that occupies very little space when stored.

Conventional, free standing ironing boards provide a rigid, planar deck adequate in at least one dimension for such purposes, and such ironing boards offer other features of interest where space is at a premium. For example, they usually fold for storage, having adjustable legs that provide heights ranging from nearly flat on the floor to well above the waist of an average person. Ironing boards, however, are relatively narrow in their transverse dimension. To take advantage of the features offered by an ironing board, a need exists for a means to convert it to a utility table.

Folding table tops without legs are old in the art, various means having been devised to expand the work surface of card tables, dining room tables and even ironing boards. E. F. Fraser, U.S. Pat. No. 2,942,922, provides a detachable, folding table top comprising two sections coupled end-to-end to exceed the longitudinal length of a conventional ironing board while substantially expanding its transverse width. Fraser's attachment means, however, relies upon a plurality of clamping heads operated by thumb plates that secure the table top to the planar deck in the transverse dimension. Faser thereby depends almost entirely upon friction to secure the table top in both the longitudinal and vertical dimensions. Because Fraser's piano hinge coupling means extends below the lower surface of the table top, the ironing board must have a pad with sufficient cushioning to prevent the hinge from causing the table top to wobble. Since most commercially available ironing boards have a pad that wraps around the planar deck, Fraser's attachment means are even less reliable with such a pad in place. A need exists, therefore, for a folding table top that can reliably convert an ironing board into a stable, secure utility table.

SUMMARY OF THE INVENTION

Accordingly, it is an object of this invention to provide a utility table which minimizes storage space requirements while providing a large work surface when employed.

It is another object of this invention to provide a utility table with adjustable legs for changing the height of the work surface.

It is yet another object of this invention to provide a utility table top which easily can be folded for storage.

It is still another object of this invention to provide a folding utility table top that converts an ironing board into a utility table.

The foregoing and other objects of this invention are achieved by providing a foldable table top for converting an ironing board to a utility table. The table top preferably comprises equivalent rectangular sections coupled together by a flexible hinge. Two handles on opposite ends of the table top latch together to hold the table top in a folded position for storage and transportation. The handles double as attachment brackets that pivot beneath the ironing board deck, snugly receiving each end of the deck within a recess to sandwich the ends between the handles and the bottom of the table top. If the ironing board has adjustable legs, the resulting utility table may be lowered or raised to the extent of the adjustment of the ironing board legs for the convenience of the user.

BRIEF DESCRIPTION OF THE DRAWINGS

The novel features believed characteristic of the present invention are set forth in the appended claims. The invention itself, however, as well as a preferred mode of use and further objects and advantages thereof, will best be understood by reference to the following detailed description of an illustrative embodiment when read in conjunction with the accompanying drawings, wherein:

DETAILED DESCRIPTION OF A PREFERRED EMBODIMENT

Figure 1:
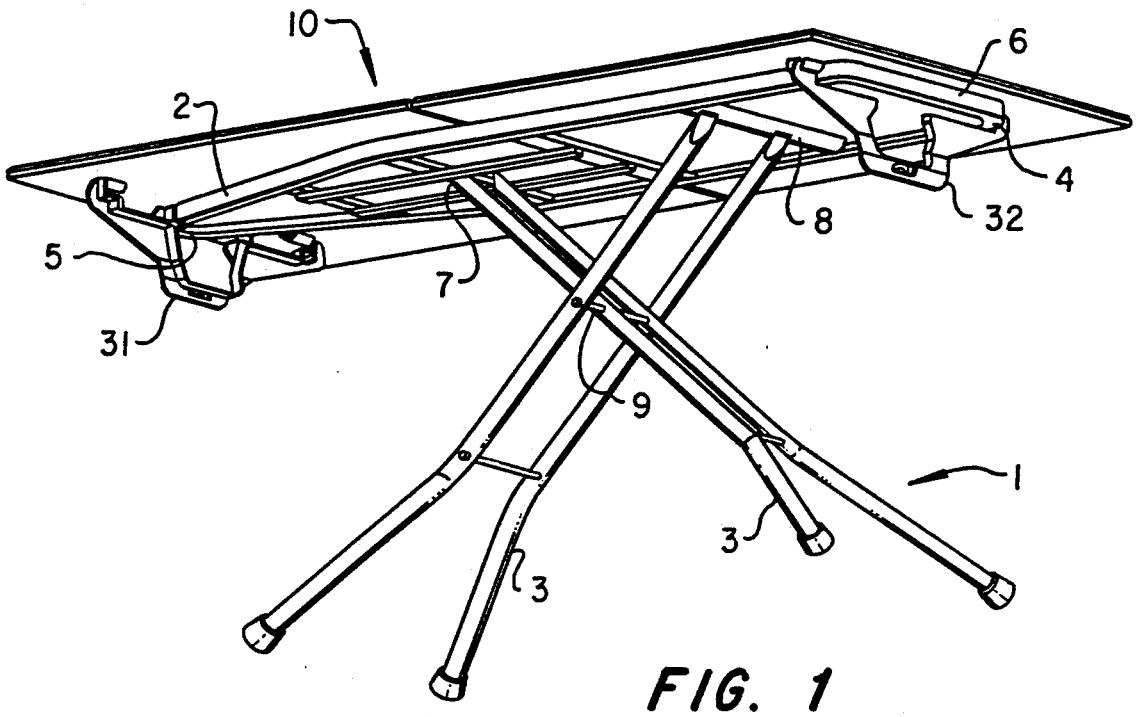
FIG. 1 depicts in perspective an ironing board with the table top of the present invention installed.
Figure 2:
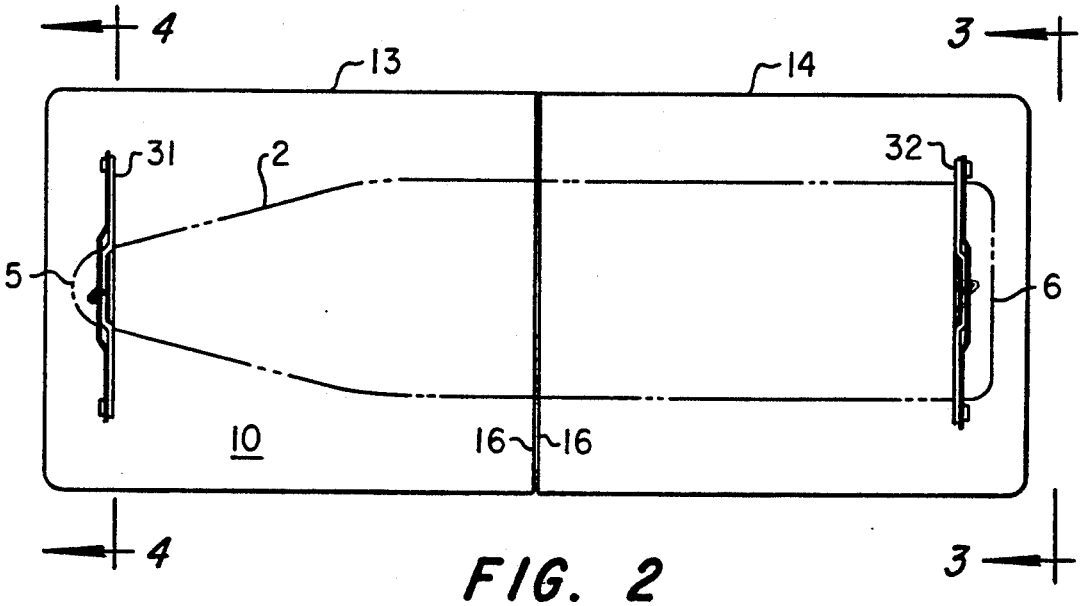
FIG. 2 shows a bottom view of the table top in place with the planar deck of the ironing board of FIG. 1 shown in phantom.

With reference now to the figures, and in particular to FIGS. 1 and 2, the table top 10 of the present invention is shown installed on a conventional, free standing ironing board 1. Ironing board 1 comprises planar deck 2 having a substantially trapezoidal, rounded front end 5 and a substantially rectangular rear end 6. Adjustable legs 3, attached to the lower surface of deck 2 at fixed attachment 8 and slidable attachment 7, share common pivot 9, thereby forming a generally scissors-like structure. When slidable attachment 7 is moved relative to fixed attachment 8, the structure of the legs 3 permits vertical adjustment of the height of deck 2 above a horizontal surface, such as a floor, upon which legs 3 rest. Pad 4 may surround the upper surface and sides of deck 2 to provide a cushioned surface for ironing.

Table top 10 is installed onto the upper surface of deck 2, widening and lengthening it to provide an expanded work surface. As depicted proportionally in FIG. 2, wherein deck 2 is shown in phantom, table top 10 extends beyond longitudinal ends 5, 6 of ironing board 1 while substantially doubling its transverse width, thereby more than doubling the work surface. Of course, one having ordinary skill in the relevant art will recognize that the size and proportions of table top 10 may vary without departing from the scope and spirit of the present invention. Two handles 31, 32 double as attachment means to secure table top 10 to deck 2.

Table top 10 depicted in FIGS. 1 and 2 comprises two sections 13, 14 substantially equivalent in size and shape and coupled together by transverse hinge 20 along opposing edges 16 juxtaposed between sections 13 and 14. Edge 16 of front section 13 defines the trailing edge of section 13 because it is the farthest edge from the front end of table top 10, located at the hinge 20 end thereof. In like fashion, edge 16 of section 14 defines the leading edge of section 14 because it is the edge of section 14 closest to the front end of the table top 10.

Table top 10 may be made from a number of materials available in sheet form, such as acrylic or polycarbonate thermoplastic resins or polyester thermoset resins, which exhibit among their advantages the properties of strength and lightness of weight. Table top 10 is preferably made from a such thermoplastic resin known as ABS (Acetate butadiene styrene), typified by Product No. 6210-12053-41 available from Spartech Plastics Company of Mansfield, Tex. One having ordinary skill in the art will recognize that the table top could be fabricated from a number of alternative materials, such as wood, metal, hard rubber, or tempered glass, without departing from the scope and spirit of the present invention.

Figure 8:
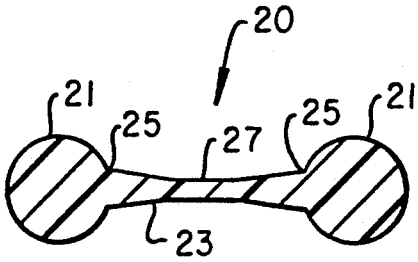
FIG. 8 details in cross section the hinge of FIG. 7.

Hinge 20, coupling sections 13, 14 at their trailing and leading edges 16 respectively, comprises two substantially cylindrical dowels 21 coupled along their length by flexible flange 23, resulting in the substantially "dumbbell" shaped cross section depicted in FIG. 8. Flange 23 preferably has a neck 25 adjacent dowel 21, neck 25 tapering to a waist 27 straddling the longitudinal axis of hinge 20. Hinge 20 extends the transverse width of sections 13, 14, providing for a continuous hinge 20 across the entire transverse width of table top 10. Of course, hinge 20 could comprise a plurality of shorter hinge segments arranged sequentially along the length of channel 17.

Figure 7:
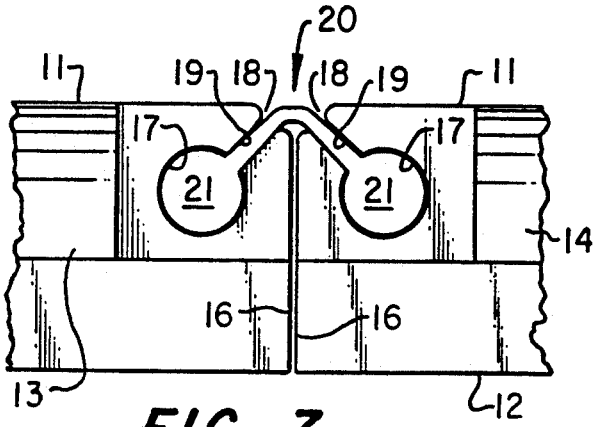
FIG. 7 details a hinge, channel and slot assembly coupling two sections of the table top.
Figure 9:
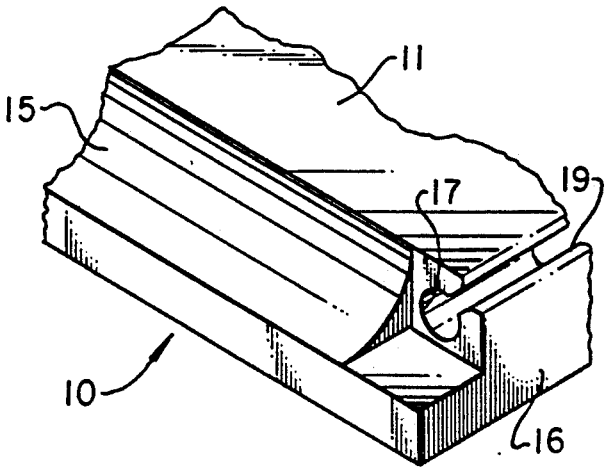
FIG. 9 depicts in partial perspective view an edge of one section of the table top bearing the channel and slot of FIG. 7.

One each of dowels 21 cooperates with one of two substantially cylindrical channels 17 in edges 16 of a sections 13, 14, channels 17 being adapted to receive dowels 21 internally. As depicted in FIGS. 7 and 9, elongated slot 19 communicates between channel 17 and adjacent edge 16 along their entire length transverse table top 10. Slot 19 opens toward edge 16 to intersect it near the corner between edge 16 and top 11 of each section 13, 14. Slot 19 thereby displaces a portion of the material of table top 10 that would be present were top 11 and edge 16 projected to their point of intersection.

Flange 23 substantially fills the gap created by slot 19 at this corner. Flange 23 extends through slot 19 in front section 13 to its trailing edge 16 and across the space between the sections 13, 14 to enter slot 19 of adjacent section 14, thereby reaching opposing channel 17 and opposing dowel 21 therein. With hinge 20 in place in channel 17, and with table top 10 fully unfolded and installed on the ironing board 1, two small depressions 18 extend across the transverse width of table top 10. Because of the cross sectional shape of flange 23, waist 27 aligns substantially flush with top 11, thereby minimizing depressions 18, resulting in minimal disruption to the uniformity of top 11 of table top 10.

Hinge 20 is preferably fabricated by extrusion from a group of materials commonly known in the art as polyolefin polymers. One having ordinary skill in the art will recognize that hinge 20 could be fabricated from other substitute materials without departing from the scope and spirit of the present invention.

Figure 3:
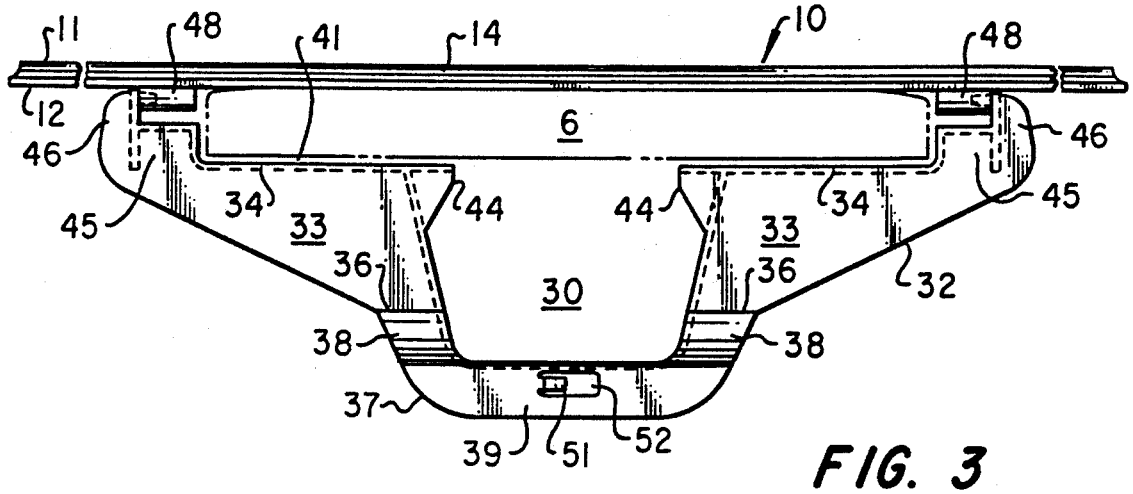
FIG. 3 shows a rear end view of the table top and ironing board of FIG. 2.
Figure 4:
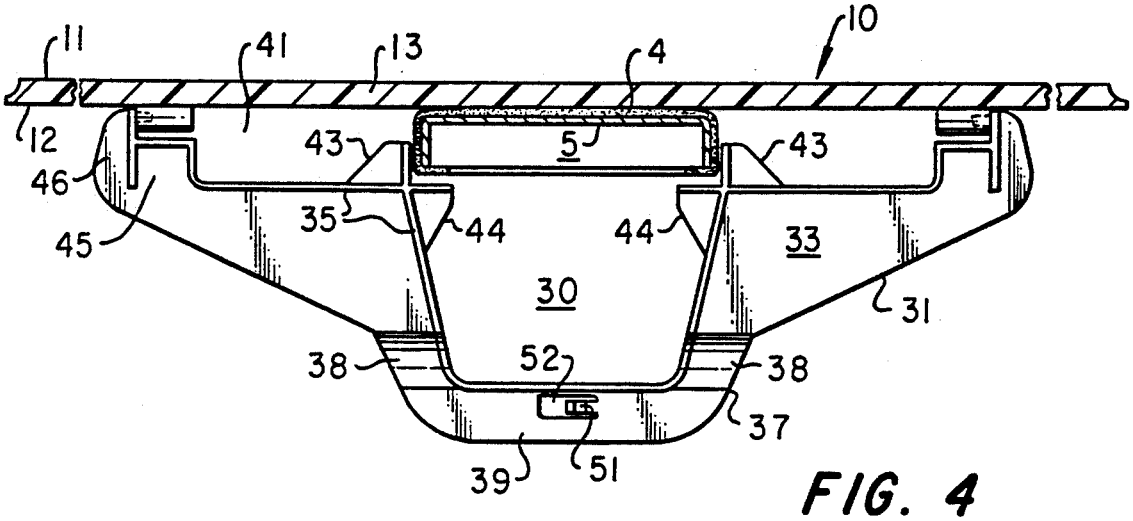
FIG. 4 shows a section view through the front end of the table top and ironing board of FIG. 2.

As detailed in FIGS. 3 and 4, each of handles 31, 32 comprises two substantially trapezoidal bodies 33 having a large base 34 and opposing small base 36, bodies 33 being spaced apart and linked between their small bases 36 by grip 37 to define hand opening 30. An arm 45 extends coplanar with each body 33 from an end of large base 34 opposite hand opening 30 and in a direction opposite small base 36. A strengthening rib 35 extends perpendicular to the plane formed by handles 31, 32 adjacent the perimeter of hand opening 30 and recess 41. Base tabs 44 extend coplanar with bodies 33 and in line with large bases 34 into opening 30. Though shown as separate tabs 44 attached to bodies 33, base tabs 44 could extend across opening 30 to physically unite large bases 34 into a unified handle base (not shown). One having ordinary skill in the art will recognize that the effect of base tabs 44 and large bases 34 acting in concert as shown is the same as a unified handle base. Where convenient to do so herein, large bases 34 and base tabs 44 will be referred to together as a unified handle base.

Figure 4A:
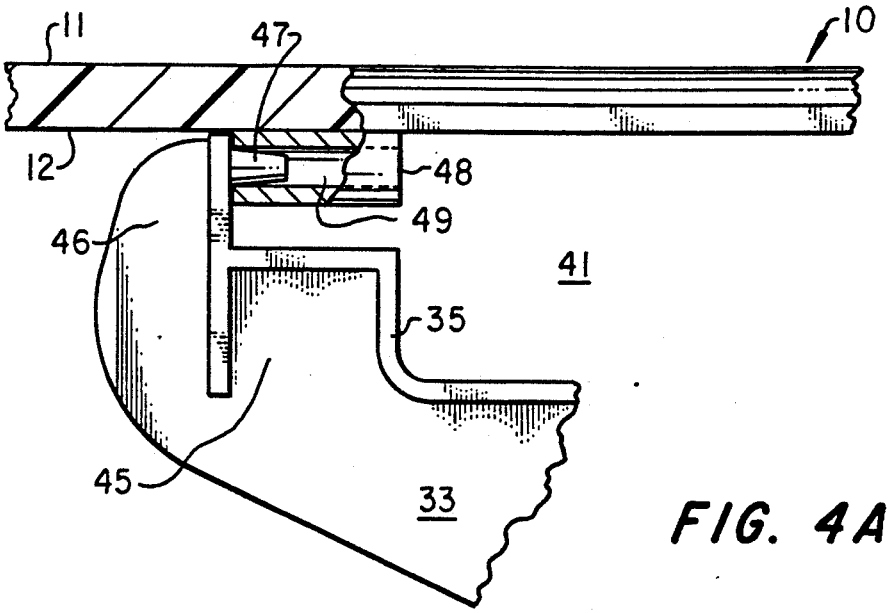
FIG. 4A shows in breakaway detail the pin and barrel system for attachment of the handle of FIG. 4 to the table top.

Each arm 45 includes toe 46 extending further opposite small base 36 and bearing pin 47 oriented coplanar with body 33 and directed inward toward recess 41. Grommet 48 is secured to bottom 12 of table top 10 by convenient means such as glue or screws, or grommet 48 may be made integrally with table top 10 during manufacture thereof. As detailed in FIG. 4A, each grommet 48 includes a barrel aperture 49 adapted to receive internally pin 47, thereby pivotally securing handles 31, 32 to table top 10.

Figure 5:
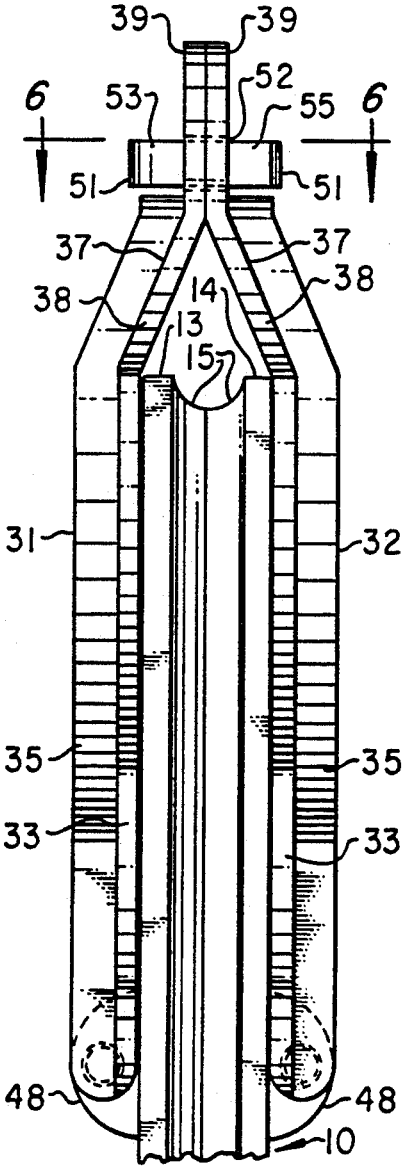
FIG. 5 shows in fragmentary view one side of the table top folded for storage, and depicts the handles latched together.

The unified handle base (large bases 34 in concert with base tabs 44) and arms 45 define three-sided recess 41 substantially the width of rear end 6 of ironing board 1. As seen in FIGS. 1-3, recess 41 is adapted to receive internally rear end 6 of ironing board 1, sandwiching rear end 6 between large bases 34 and bottom 12 of table top 10 when rear handle 32 is pivoted to a position substantially perpendicular to the plane of table top 10. Further pivoting of handle 32 away from rear end 6 of ironing board 1 serves to increase the snug fit that secures table top 10 to ironing board 1, while pivoting handle 32 toward rear end 6 of ironing board 1 releases table top 10 for removal. In like fashion, front handle 31 pivots to receive internally front end 5 of ironing board 1 between tabs 43 within recess 41. As shown in FIG. 5 and discussed further below, handles 31, 32 pivot to a position parallel to the plane of table top 10, reaching beyond it to latch together and form a carrying means.

Tabs 43 on front handle 32 serve as stops for limiting horizontal movement of table top 10 at front end 5 of ironing board 1. These tabs 43 constitute the difference between front handle 31 and rear handle 32. Because of the snug fit between the unified handle base and bottom 12 of table top 10, tabs 43 merely assist the frictional resistance to movement at front end 5 and are not critical to the operation of table top 10. Since ironing boards vary in their transverse width at the front end 5, handle 31 may be fabricated with tabs 43 further apart than shown in FIG. 4 or omitted altogether to accommodate wider ironing boards. Alternately, tabs 43 may be made adjustable to accommodate different ironing boards by fabricating the tabs 43 separately and with a clamp (not shown) capable of being attached at any point along large base 34 by a set screw (not shown) or other suitable means.

Grip 37 extends from small base 36 of each body 33 opposite recess 41 of handles 31, 32. Grip 37 comprises two sloped portions 38 spaced apart and linked by crossbar 39. As seen in FIG. 5, grips 37 are not coplanar with bodies 33 of handles 31, 32, but slope to offset crossbars 39 from bodies 33. Crossbars 39 thus define planes parallel to the plane of bodies 33 but offset a distance approximating the thickness of table top 10. In this fashion, crossbars 39 are juxtaposed beyond the ends of table top 10 when table top 10 is folded for storage or transportation.

Figure 6:
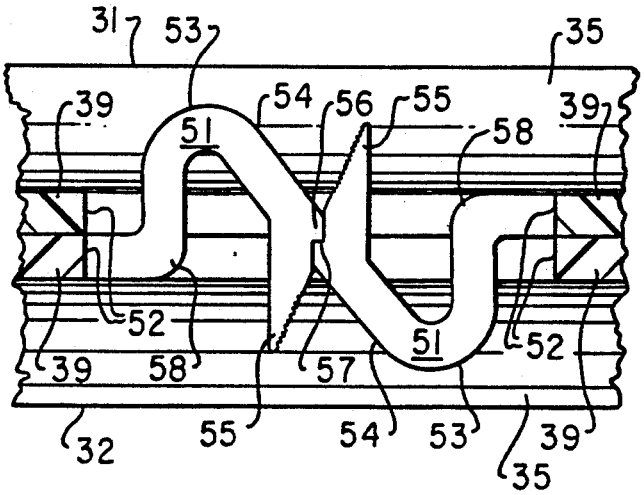
FIG. 6 details in partial section of FIG. 5 the latch mechanism holding the handles together.

When table top 10 is so folded, latch 50 secures handles 31, 32 together to form a carrying means. As seen in FIG. 6, latch 50 comprises two arcuate, flexible tangs 51, one carried in each crossbar 39 such that tang 51 of handle 31 contacts opposing tang 51 carried on the crossbar 39 of handle 32. Tangs 51 extend through ports 52 in crossbars 39 and in a plane perpendicular to the plane formed by crossbars 39.

Each tang 51 comprises a knuckle 58 coupled to crossbar 39, elbow 53 coupled between knuckle 58 and contact 54, tooth 56 at the opposite end of contact 54 and finger lever 55 beyond tooth 56 and opposite knuckle 58. Elbow 53 of handle 32 extends transverse crossbars 39 in the opposite direction of rib 35 of handle 32, while finger lever 55 of handle 32 extends back through ports 52 and beyond crossbars 39. Tooth 56 extends toward the end of port 52 opposite knuckle 58 and bears flat face 57 substantially coplanar with crossbar 39 and oriented toward finger lever 55.

As demonstrated in FIG. 6, tangs 51 are substantially mirror images of each other. In this configuration, when handles 31, 32 are brought together, contacts 54 meet. Being flexible and resilient, elbows 53 bend as crossbars 39 are pushed toward each other, permitting tangs 51 to slide laterally relative to each other until faces 57 align and snap into opposing contact, securing tangs 51 together. To release handles 31, 32 from each other, the process is reversed. Finger levers 55 are depressed in opposite directions, releasing each tooth 56 from the other by translating faces 57 in opposite directions toward knuckles 58 until faces 57 and teeth 56 no longer contact. This permits tangs 51 to slide past each other crossbars 39 are pushed apart.

Handles 31, 32 are preferably made from a group of materials known in the art as polymers having among their advantages the property of being easily injection molded. One having ordinary skill in the relevant art will recognize that handles 31, 32 could also be made from a number of alternative materials, such as metal, wood, hard rubber or the like, without departing from the scope and spirit of the present invention.

In operation, table top 10 is unfolded and stretched along the longitudinal length of ironing board 1 with handles 31, 32 extending toward the floor. Handles 31, 32 are then pivoted toward the center of ironing board 1 until they snugly grasp ends 5, 6 of ironing board 1. Legs 3 are adjusted before or after installation of table top 10 to optimize the height of the working surface on top 11, resulting in a work surface most convenient to the user. After use, table top 10 may be folded for storage by pivoting handles 31, 32 toward ends 5, 6 of ironing board 1, thereby releasing table top 10. The handle ends of table top 10 are then lifted toward each other until juxtaposed, whereupon handles 31, 32 are latched together by depressing crossbars 39 until tangs 51 flex and snap into latched position. Table top 10 may then be lifted by handles 31, 32 and stood on its edges 16 for convenient, space saving storage.

One having ordinary skill in the art will recognize that table top 10 will actually accommodate ironing boards longer than table top 10. To use table top 10 with longer ironing boards, it would first be placed upon the ironing board deck 2 and handle 32 placed over the rectangular rear end 6. Table top 10 then would be slid toward front end 5 of until front handle 31 could be slipped over end 5. Table top 10 would then be adjusted back toward rear end 6 until front handle 31 limits its travel. Rear handle 32 would then be pivoted until it snugly grips the deck 2 even though it probably could not be released until the procedure was reversed. In this fashion, ironing boards of varying lengths can be used with one table top 10.

While the invention has been particularly shown and described with reference to a preferred embodiment, it will be understood by those skilled in the art that various changes in form and detail may be made therein without departing from the spirit and scope of the invention. For example, in an alternate embodiment, handles 31, 32 could be formed from bent steel rod (not shown) forming recesses adequate to accept ends 5, 6 of ironing board 1. A simple U-clamp (not shown) sized to fit the rod could be affixed to bottom 12 of table top 10 to provide the pivotal attachment means. As another example, latch 50 could be omitted or replaced with other means to secure handles 31, 32, such as a hasp (not shown). Also, handles 31, 32 could be of different sizes or contour to compliment the contour of different shaped ironing boards. As another alternative, where the handle material selected is rigid and strong, the strengthening rib 35 may be unnecessary. As yet another example, a piano hinge (not shown), with its pin and barrel recessed below the top surface 11, could replace the hinge 20 spanning the transverse width of the table top at the leading and trailing edges 16. The piano hinge would likely require countersunk rivets or bolts for attachment to the table top 10. One having ordinary skill in the art will recognize that these and other variations are within the spirit and scope of the present invention.

I claim:

1. A table top adapted to be attached to an ironing board, the ironing board being of the type having a substantially planar deck having a top surface, a front end and a back end, the table top comprising a plurality of planar sections, each section having a top, a bottom, a leading edge and a trailing edge, the sections juxtaposed sequentially along a longitudinal axis between a forward end and a rear end of the table top;

hinge means for hingeably coupling the trailing edge of one section to the leading edge of an adjacent section juxtaposed rearward along the longitudinal axis of the table top; and attachment means on the bottoms of the sections at each end of the table top for attaching the table top to the top surface of the ironing board, each attachment means having two coplanar bodies, each body having a large base adjacent the bottom of the table top and a small base opposite the large base, the bodies spaced apart on either side of an opening;

a grip coupled to the small base of each body and extending opposite the large base across the opening;

two arms extending coplanar with the bodies opposite the small bases, one arm on each end of the large base opposite the opening to define a recess adapted to sandwich one of the front or back ends of the ironing board between the large bases and the bottom of the section; and pivot means for pivotally securing the arms to the bottom of the table top.

2. The table top according to claim 1 wherein the pivot means comprises a toe extending coplanar with each arm;

a pin carried on each toe adjacent the recess; and a grommet affixed to the bottom of the table top, the grommet having a barrel adapted to pivotally receive internally the pin.

3. The table top according to claim 1 wherein the grip further comprises a pair of sloped portions, one each coupled to the small base of a body;

a crossbar coupled between the sloped portions opposite the bodies.

4. The table top according to claim 3 wherein the crossbar further comprises latch means for latching the grips together to secure the table top in a folded position for storage and transportation.

5. The table top according to claim 4 wherein the latch means comprises an arcuate tang having opposing ends, one end coupled to the grip, the tang and extending in a plane perpendicular to a plane formed by the grip to terminate in a free end opposite the grip, the free end adapted to contact the free end of an opposing tang carried on the grip of the other attachment means when the table top is folded, the finger further having a tooth adjacent the free end, the tooth adapted to cooperate with a tooth on the opposing tang to hold the tangs together.

6. A utility table comprising, in combination an ironing board having a substantially planar top surface, a front end and a longitudinally opposing rear end, and a plurality of legs extending from the bottom surface for supporting the ironing board in at least one vertical position above and substantially parallel to a horizontal surface; and a table top adapted to attached to the top surface of the ironing board, the table top comprising two planar sections forming front and rear halves of the table top, each half having a top, a bottom and a length substantially the length of the other half, the halves being juxtaposed along the longitudinal length of the ironing board;

hinge means coupled between the front and rear halves for folding the table top for storage and transportation; and attachment means pivotally coupled to the bottom of each half adjacent ends opposite the hinge means, each attachment means comprising a substantially trapezoidal body having a large base adjacent the bottom of the half and a small base opposite the large base, the large base having a recess adapted to receive internally one of the front or rear ends of the ironing board;

pivot means on either side of the large base for hingeably securing the attachment means to the table top;

a grip coupled to the small base; and latching means for latching one attachment means to the other for securing the table top in a folded position.

7. The utility table according to claim 6 wherein the hinge means comprises at least one hinge having opposing, parallel dowels coupled together along their length by at least one flexible flange; and a channel within each half of the table top proximate a transverse edge juxtaposed to the other half of the table top, each channel having a slot communicating between the channel and the transverse edge, each channel further adapted to receive and retain internally one dowel respectively of the hinge whereby the flexible flange extends from one dowel in one channel through both slots sequentially to the opposing dowel of the hinge retained in the other channel within the other half of the table top.

8. An improvement for an ironing board of the type having a substantially planar top surface, a bottom surface opposite the top surface, a rear end and a longitudinally opposite front end, each end having a transverse width, the improvement comprising a table top adapted to be removably attached to the top surface for increasing the size of the ironing board, the table top further comprising two planar sections forming front and rear halves of the table top, each half having a top, a bottom and a length substantially half the length of the table top, the halves being juxtaposed along the longitudinal length of the ironing board;

hinge means for hingeably coupling together the front and rear halves of the table top for folding the table top longitudinally in half for storage and transportation; and attachment means pivotally attached to the bottom of each half at opposing ends of the table top, each attachment means comprising a substantially trapezoidal body having a large base adjacent the table top and an opposing small base, the large base having a recess sized to surround the transverse width of an end of the ironing board and to sandwich the end between the large base and the bottom of the section;

pivot means on either side of the recess for pivotally securing the attachment means to the table top;

a grip coupled to the small base of the body and extending opposite the pivot means beyond the end of the table top; and latch means for latching the handle of one attachment means to the handle of the other attachment means for securing the table top in a folded position.

9. A method of providing a utility table, the method comprising providing an ironing board having a substantially planar deck having a top surface, a bottom surface, a rear end and a longitudinally opposite front end, the ironing board further having a plurality of adjustable legs extending from the bottom surface;

providing a table top adapted to be removably attached to the top surface of the deck, the table top further comprising two planar sections forming substantially equivalent front and rear halves of the table top, each half having a top and a bottom, the halves being juxtaposed along a longitudinal length of the table top;

hinge means coupled between the front and rear halves of the table top; and attachment means pivotally attached to the bottom of each half at opposite ends of the table top, each attachment means comprising a body having a recess;

pivot means on either side of the recess for pivotally securing the attachment means to the table top;

a grip coupled to the body opposite the recess; and latch means for latching the grip to the other attachment means for securing the table top in a folded position;

erecting the ironing board on a horizontal surface; then adjusting the legs of the ironing board to position the deck a selected distance above the horizontal surface; then positioning the table top onto the top surface of the deck with the attachment means extending toward the horizontal surface at each end of the ironing board; then pivoting each attachment means to engage an end of the ironing board within the recess.

10. A table top adapted to be attached to an ironing board of the type having a substantially planar deck with a top surface, a front end and a back end, the table top having a forward end and a back end and further comprising a plurality of planar sections, each section having a top, a bottom, a leading edge and a trailing edge;

hinge means for hingeably coupling the leading edge of one section to the trailing edge of an adjacent section along a longitudinal axis of the table top; and attachment means on the bottom of one section at each end of the table top for attaching the table top to the top surface of the ironing board, each attachment means comprising two coplanar bodies, each body having a large base adjacent the bottom of the table top and a small base opposite the large base, the bodies spaced apart on either side of an opening;

a grip coupled to the small base of each body and extending opposite the large base across the opening;

two arms extending coplanar with the bodies opposite the small bases, one arm on each end of the large base opposite the opening to define a recess in the large base, the recess adapted to confine an end of the ironing board between the large base and the bottom of the section; and pivot means for pivotally securing the arms to the bottom of the table top.

11. The table top according to claim 10 wherein the pivot means comprises a toe extending coplanar with each arm;

a pin carried on each toe adjacent the recess; and a gromment affixed to the bottom of the table top, the gromment having a barrel adapted to pivotally receive internally the pin.

12. The table top according to claim 10 wherein the grip further comprises a pair of sloped portions, one each coupled to the small base of a body;

a crossbar coupled between the sloped portions opposite the bodies.

13. The table top according to claim 12 wherein the crossbar further comprises latch means for latching the grips together to secure the table top in a folded position for storage and transportation.

14. The table top according to claim 13 wherein the latch means comprises an arcuate tang having opposing ends, one end coupled to the grip, the tang and extending in a plane perpendicular to a plane formed by the grip to terminate in a free end opposite the grip, the free end adapted to contact the free end of an opposing tang carried on the grip of the other attachment means when the table top is folded, the finger further having a tooth adjacent the free end, the tooth adapted to cooperate with a tooth on the opposing tang to hold the tangs together.

15. A table top adapted to be removably attached to an ironing board of the type having a substantially planar top surface and a front end and a longitudinally opposing rear end, the table top comprising two planar sections forming front and rear halves of the table top, each half having a top, a bottom and a length substantially the length of the other half, the halves being juxtaposed along the longitudinal length of the ironing board;

hinge means coupled between the front and rear halves for folding the table top for storage and transportation, the hinge means comprising at least one hinge having opposing, parallel dowels coupled together along their length by at least one flexible flange; and a channel within each half of the table top proximate a transverse edge juxtaposed to the other half of the table top, each channel having a slot communicating between the channel and the transverse edge, each channel further adapted to receive and retain internally one dowel respectively of the hinge whereby the flexible flange extends from one dowel in one channel through both slots sequentially to the opposing dowel of the hinge retained in the other channel within the other half of the table top; and attachment means pivotally coupled to the bottom of each half adjacent ends opposite the hinge means, each attachment means comprising a substantially trapezoidal body having a large base adjacent the bottom of the half and a small base opposite the large base, the large base having a recess adapted to receive internally an end of the ironing board;

pivot means on either side of the large base for pivoting the trapezoidal body into a plane substantially normal to the bottom of the section to engage one end of the ironing board within the recess to secure the table top to the ironing board;

a grip coupled to the small base; and latching means for latching one attachment means to the other for securing the table top in a folded position.

* * * * *